US010833393B2

(12) United States Patent
Liu et al.

(10) Patent No.: US 10,833,393 B2
(45) Date of Patent: Nov. 10, 2020

(54) ANTENNA ADJUSTMENT METHOD, ADJUSTMENT APPARATUS, CONTROLLER, AND TERMINAL

(71) Applicant: ZTE CORPORATION, Shenzhen (CN)

(72) Inventors: Fengpeng Liu, Shenzhen (CN); Dongmei Liu, Shenzhen (CN)

(73) Assignee: ZTE CORPORATION, Shenzen (CN)

( * ) Notice: Subject to any disclaimer, the term of this patent is extended or adjusted under 35 U.S.C. 154(b) by 57 days.

(21) Appl. No.: 16/310,118

(22) PCT Filed: Sep. 18, 2016

(86) PCT No.: PCT/CN2016/099248

§ 371 (c)(1),
(2) Date: Dec. 14, 2018

(87) PCT Pub. No.: WO2017/215140

PCT Pub. Date: Dec. 21, 2017

(65) Prior Publication Data

US 2019/0140339 A1 May 9, 2019

(30) Foreign Application Priority Data

Jun. 17, 2016 (CN) ..... 2016 1 0438909

(51) Int. Cl.
*H01Q 1/12* (2006.01)
*H01Q 1/42* (2006.01)

(52) U.S. Cl.
CPC ..... *H01Q 1/1264* (2013.01); *H01Q 1/42* (2013.01)

(58) Field of Classification Search
CPC ..... H01Q 1/12; H01Q 1/1264; H01Q 1/24; H01Q 1/42
See application file for complete search history.

(56) References Cited

U.S. PATENT DOCUMENTS

2012/0218723 A1 8/2012 Kwak et al.
2014/0159989 A1* 6/2014 Malek ..... H01Q 1/243 343/876

FOREIGN PATENT DOCUMENTS

CN 102447165 A 5/2012
CN 202695729 U 1/2013

* cited by examiner

*Primary Examiner* — Hoang V Nguyen
(74) *Attorney, Agent, or Firm* — Cantor Colburn LLP

(57) ABSTRACT

The present disclosure relates to an antenna adjustment method, an antenna adjustment device, a controller and a terminal. The method includes: determining adjustment information for adjusting an antenna in a metal casing of a terminal; and adjusting the antenna according to the determined adjustment information.

6 Claims, 6 Drawing Sheets

ANTENNA ADJUSTMENT METHOD, ADJUSTMENT APPARATUS, CONTROLLER, AND TERMINAL

CROSS REFERENCE

The present application is a continuing application of International Application No. PCT/CN2016/099248, filed on Sep. 18, 2016, which is based upon and claims priority to Chinese Patent Application No. 201610438909.4, filed on Jun. 17, 2016, and the entire contents thereof are incorporated herein by reference.

TECHNICAL FIELD

The present disclosure relates to communication technologies, and in particular to an antenna adjustment method, an adjustment device, a controller and a terminal.

BACKGROUND

The wireless communication experience is one of the most important performance indicators for a terminal device. The communication quality is closely related to the user usage scenarios (including signal strength, etc.), user usage habits (including hand gestures, etc.), network frequency bands used by the terminal device, and differences in the above conditions may cause different communication quality of the terminal device.

In the terminal wireless communication scheme in related arts, the proportion of all-metal terminals is getting larger and larger, and the antenna design in the all-metal terminal is very difficult, and the metal casing that cannot be arbitrarily designed must be used as the antenna wiring. Different use environments, different user habits, and different network bands often result in a large difference in antenna performance. However, there is not much solution in the related arts, because the metal casing is already determined and cannot be modified arbitrarily.

Therefore, for a terminal of an all-metal casing, when the environment in which the terminal is located (for example, the system and/or frequency band actually used by the terminal, the signal quality of the actually used network band, and the area where the terminal is actually covered for example by fingers or palm of a user) are changed, because the antenna trace of the terminal is fixed and the terminal multi-band antenna is difficult to implement and/or the terminal supports a small number of system frequency bands, the terminal antenna performance is deteriorated, thereby causing the communication quality to become poor and affecting user experiences.

For the above problems, no effective solution has been proposed in the related arts.

SUMMARY

Embodiments of the present disclosure provide an antenna adjustment method, an adjustment device, a controller, and a terminal, so as to at least address the technical problem in related art that when the environments in which the terminal is located are changed, because the terminal multi-band antenna is difficult to implement and/or the terminal supports a small number of system frequency bands, the terminal antenna performance is deteriorated, thereby causing the communication quality to become poor and affecting user experiences.

According to an embodiment of the present disclosure, there is provided an antenna adjustment method, including:

determining adjustment information for adjusting an antenna in a metal casing of a terminal; and adjusting the antenna according to the determined adjustment information.

According to an embodiment of the present disclosure, adjusting the antenna according to the determined adjustment information, includes:

adjusting a position of a connection point of the metal casing of the terminal and a main-board of the terminal according to the determined adjustment information.

According to an embodiment of the present disclosure, adjusting a position of a connection point of the metal casing of the terminal and a main-board of the terminal according to the determined adjustment information, includes:

adjusting a position of a connector in the terminal according to the determined adjustment information, wherein the connector is located in a space of a guide rail formed by at least one groove on the metal casing and at least one groove on the main-board, the at least one groove on the metal casing correspond to the at least one groove on the main-board in a one-to-one manner, and the connector is disposed to connect the metal casing and the main-board.

According to an embodiment of the present disclosure, adjusting the position of the connector in the terminal according to the determined adjustment information includes at least one of:

adjusting an insulated transmission cable which is used for connecting the connector by a motor provided at at least one end of the guide rail;

adjusting attractive force for attracting the connector by an electromagnetic attractive machine provided at at least one end of the guide rail;

adjusting a gas force by an air pump disposed at at least one end of the guide rail; and adjusting hydraulic pressure by a hydraulic pump provided at at least one end of the guide rail.

According to an embodiment of the present disclosure, there is provided an antenna adjustment device, including:

a determination module configured to determine adjustment information for adjusting an antenna in a metal casing of a terminal; and an adjustment module configured to adjust the antenna according to the determined adjustment information.

According to an embodiment of the present disclosure, the adjustment module includes:

an adjustment unit configured to adjust a position of a connection point of the metal casing of the terminal and a main-board of the terminal according to the determined adjustment information.

According to an embodiment of the present disclosure, the adjustment unit, includes:

an adjustment sub-unit configured to adjust a position of a connector in the terminal according to the determined adjustment information, wherein the connector is located in a space of a guide rail formed by at least one groove on the metal casing and at least one groove on the main-board, the at least one groove on the metal casing correspond to the at least one groove on the main-board in a one-to-one manner, and the connector is disposed to connect the metal casing and the main-board.

According to an embodiment of the present disclosure, the adjustment sub-unit includes:

an adjustment sub-unit configured to adjust the position of the connector in the terminal according to the determined adjustment information in at least one of the following manners:

adjusting an insulated transmission cable which is used for connecting the connector by a motor provided at at least one end of the guide rail;

adjusting attractive force for attracting the connector by an electromagnetic attractive machine provided at at least one end of the guide rail;

adjusting a gas force by an air pump disposed at at least one end of the guide rail; and adjusting hydraulic pressure by a hydraulic pump provided at at least one end of the guide rail.

According to an embodiment of the present disclosure, there is provided a controller including the device as described above.

According to an embodiment of the present disclosure, there is provided a terminal, including the controller as described above, a metal casing, a main-board, a connector for connecting the metal casing and the main-board and a device for adjusting a position of the connector for connecting the metal casing and the main-board, wherein the device adjusting a position of the connector for connecting the metal casing and the main-board includes at least one of a motor, an electromagnetic attractive machine, an air pump and a hydraulic pump.

According to an embodiment of the present disclosure, there is also provided a storage medium. The storage medium is configured to store program codes for performing the above steps.

According to the present disclosure, since the antenna in the metal casing of the terminal can be adjusted according to the adjustment information, and the adjustment information is related to the environment in which the terminal is currently located, the antenna of the terminal is adjusted according to the actual environment of the terminal. Thus, the performance of the antenna and the communication quality are ensured, and the user experience is improved. As a result, the present disclosure can effectively solve the technical problem in related arts that when the environment in which the terminal is located (for example, the system and/or frequency band actually used by the terminal, the signal quality of the actually used network band, and the area where the terminal is actually covered) are changed, because the terminal multi-band antenna is difficult to implement and/or the terminal supports a small number of system frequency bands, the terminal antenna performance is deteriorated, thereby causing the communication quality to become poor and affecting user experiences.

BRIEF DESCRIPTION OF THE DRAWINGS

The drawings, which constitute a part of the description, are intended to provide a further understanding of the present disclosure. The exemplary embodiments of the present disclosure are used to explain the present disclosure but are not intended to unduly limit the present disclosure.

DETAILED DESCRIPTION

The present disclosure will be described in detail below with reference to the drawings in conjunction with the embodiments. It should be noted that the embodiments in the present application and the features in the embodiments may be combined with each other if the features or embodiments do not conflict with each other.

It should be noted that the terms "first", "second", and the like in the specification and claims of the present disclosure are used to distinguish similar objects, and are not necessarily used to describe a particular order or sequence.

Figure 1:
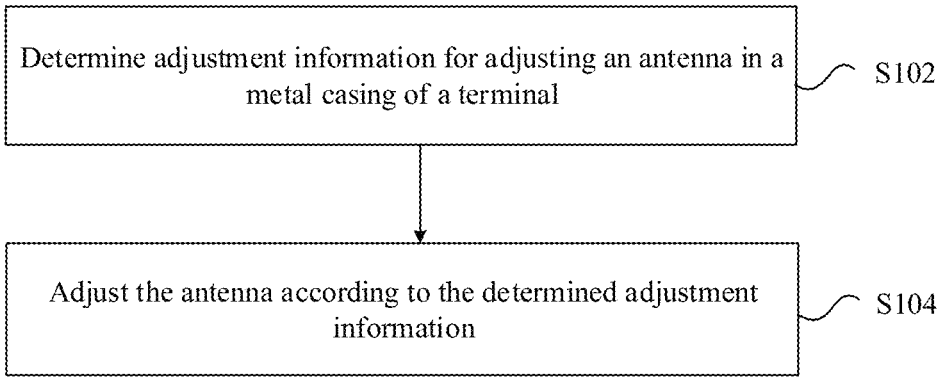
FIG. 1 is a flowchart of an antenna adjustment method according to an embodiment of the present disclosure.

In this embodiment, a method for adjusting an antenna is provided. FIG. 1 is a flowchart of an antenna adjustment method according to an embodiment of the present disclosure. As shown in FIG. 1, the method includes the following steps:

In step S102, adjustment information for adjusting an antenna in a metal casing of a terminal is determined.

In step S104, the antenna is adjusted according to the determined adjustment information.

The above operations or processes may be performed by the terminal. The adjustment information includes at least one of the following information: a network frequency band currently used by the terminal, a signal quality of a network frequency band currently used by the terminal, and the area where the terminal is actually covered (which may be a handheld mode of the user's handheld terminal).

Through the above steps, since the antenna in the metal casing of the terminal can be adjusted according to the adjustment information, and the adjustment information is related to the environment in which the terminal is currently located, the antenna of the terminal is adjusted according to the actual environment of the terminal. Thus, the performance of the antenna and the communication quality are ensured, and the user experience is improved. As a result, the technical solution in the embodiment can effectively solve the technical problem in related arts that when the environment in which the terminal is located are changed, because the terminal multi-band antenna is difficult to implement and/or the terminal supports a small number of system frequency bands, the terminal antenna performance is deteriorated, thereby causing the communication quality to become poor and affecting user experiences.

In an exemplary embodiment, in the step S104, the antenna may be adjusted according to the determined adjustment information by adjusting a position of a connection point between a metal casing of the terminal and a main-board of the terminal according to the determined adjustment information. In this embodiment, the metal casing of the terminal can serve as an antenna of the terminal, and the connection manner of the metal casing and the main-board of the terminal determines the actual layout of the antenna, and different connection modes form different antennas.

In an exemplary embodiment, adjusting the location of the connection point between the metal casing of the terminal and the main-board of the terminal according to the determined adjustment information includes: adjusting a position of a connector in the terminal according to the determined adjustment information. The connector is located in a space of a guide rail formed by at least one groove on the metal casing and at least one groove on the main-board, the at least one groove on the metal casing correspond to the at least one groove on the main-board in a one-to-one manner, and the connector is disposed to connect the metal casing and the main-board. In this embodiment, one or more grooves (for example, rectangular grooves) may be disposed on the metal casing of the terminal, and one or more grooves are correspondingly disposed on the main-board, and the grooves on the metal casing and the grooves on the main-board may be docked with each other (i.e., the grooves join together) to form a guide rail space. Therefore, one or more guide rail spaces can be formed inside the terminal, and a connector can be disposed in each rail space for connecting the metal casing and the main-board. The shape of the connector can be flexibly set. For example, the shape of the connector can be set flexibly according to the shape of the rail space. When the rail space is a cylindrical space, the connector can be set to be spherical or cylindrical. When the rail space is a space similar to a rectangular parallelepiped, the connector can be set to have a rectangular parallelepiped shape. The connector is a conductor for conducting electricity, and the material of the connector may be copper or silver, or gold or the like.

In an exemplary embodiment, the adjusting the position of the connector in the terminal according to the determined adjustment information includes at least one of: adjusting an insulated transmission cable which is used for connecting the connector by a motor (for example, a stepping motor) provided at at least one end of the guide rail; adjusting attractive force for attracting the connector by an electromagnetic attractive machine provided at at least one end of the guide rail; adjusting a gas force by an air pump disposed at at least one end of the guide rail; and adjusting hydraulic pressure by a hydraulic pump provided at at least one end of the guide rail. In the embodiment, an adjustment device (i.e., the motor, the electromagnetic attractive machine, the air pump and the hydraulic pump as mentioned above) for adjusting the position of the connector may be disposed in the terminal corresponding to each guide rail. Preferably, one adjustment device may be disposed on each of the two ends of each guide rail. Of course, in order to save the costs of the terminal, only one adjustment device can be provided for each guide rail. It should be noted that different adjustment devices may be provided corresponding to different guide rails. For example, when two guide rails are arranged in the terminal, motors may be disposed at two ends of one of the two guide rails in the terminals, respectively, and electromagnetic attractive machines may be disposed at two ends of the other one of the two guide rails in the terminals, respectively. It should also be noted that different adjustment devices may be provided for each of the guide rails. For example, a guide rail is provided with a motor and an air pump at the same time. In practical applications, one of the adjustment devices may also be preferentially used, and the other one of the adjustment devices may be used if the one of the adjustment devices has a fault.

It can be seen from the above embodiments that a method for dynamically changing the connection mode of the metal casing antenna trace and the main-board is proposed in the embodiments of the present disclosure. First, feedback on the adjustment information affecting the antenna traces are collected, the optimal antenna trace form is designed at any time, the liquid-state connection mode is controlled (i.e., flexibly adjust the antenna trace) to form the current optimal antenna trace configuration, thereby achieving optimal antenna performance.

Through the description of the above embodiments, those skilled in the art can clearly understand that the method according to the above embodiments can be implemented by means of software plus a necessary general hardware platform, and of course, can also be through hardware, but in many cases the former is a better implementation. Based on such understanding, the technical solutions of the present disclosure, which are essential or contribute to the prior art, may be embodied in the form of a software product stored in a storage medium (such as ROM/RAM, magnetic disk, optical disk) including a number of instructions for causing a terminal device (which may be a cell phone, a computer, a server, or a network device, etc.) to perform the methods described in various embodiments of the present disclosure.

An antenna adjustment device is also provided in an embodiment. The device is used to implement the above-mentioned embodiments and exemplary embodiments, and repeated descriptions will be omitted. As used below, the term "module" may be a combination of software and/or hardware for implementing a predetermined function. Although the devices described in the following embodiments are preferably implemented in software, hardware or a combination of software and hardware is also possible and contemplated.

Figure 2:
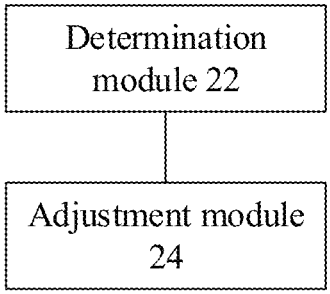
FIG. 2 is a block diagram showing the structure of an antenna adjustment device according to an embodiment of the present disclosure.

FIG. 2 is a block diagram showing the structure of an antenna adjustment device according to an embodiment of the present disclosure. As shown in FIG. 2, the device includes a determination module 22 and an adjustment module 24. The device is described below:

The determination module 22 is configured to determine adjustment information for adjusting an antenna in a metal casing of a terminal. The adjustment module 24 is coupled to the determination module 22, and configured to adjust the antenna according to the determined adjustment information.

Figure 3:
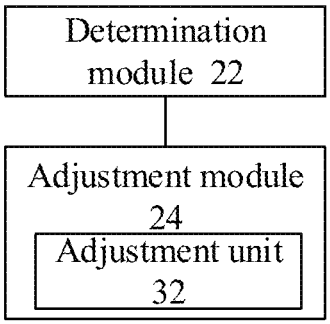
FIG. 3 is a block diagram showing the structure of an adjustment module 24 in an antenna adjustment device according to an embodiment of the present disclosure.

FIG. 3 is a block diagram showing the structure of the adjustment module 24 in the antenna adjustment device according to an embodiment of the present disclosure. As shown in FIG. 3, the adjustment module 24 includes an adjustment unit 32, and the adjustment unit 32 is described below:

The adjustment unit 32 is configured to adjust a position of a connection point of the metal casing of the terminal and a main-board of the terminal according to the determined adjustment information.

Figure 4:
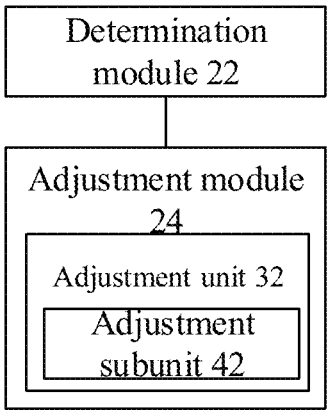
FIG. 4 is a block diagram showing the structure of an adjustment unit 32 in an antenna adjustment device according to an embodiment of the present disclosure.

FIG. 4 is a block diagram showing the structure of the adjustment unit 32 in the antenna adjustment device according to an embodiment of the present disclosure. As shown in FIG. 4, the adjusting unit 32 includes an adjustment subunit 42, and the adjustment subunit 42 is described below:

The adjustment subunit 42 is configured to adjust the position of a connector in the terminal according to the determined adjustment information. The connector is located in a space of a guide rail formed by at least one groove on the metal casing and at least one groove on the main-board, the at least one groove on the metal casing correspond to the at least one groove on the main-board in a one-to-one manner, and the connector is disposed to connect the metal casing and the main-board.

Figure 5:
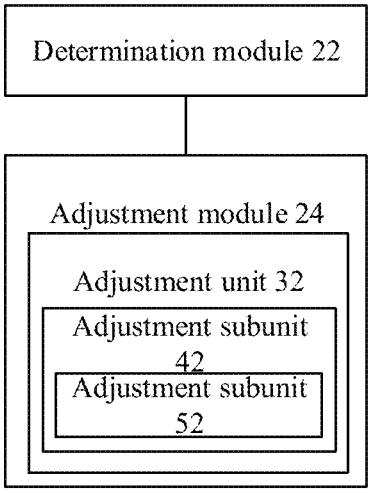
FIG. 5 is a block diagram showing the structure of an adjustment subunit 42 in an antenna adjustment device according to an embodiment of the present disclosure.

FIG. 5 is a block diagram showing the structure of the adjustment subunit 42 in the antenna adjustment device according to an embodiment of the present disclosure. As shown in FIG. 5, the adjustment subunit 42 includes an adjustment subunit 52, and the adjustment sub subunit 52 is described below:

The adjustment sub-unit 52 is configured to adjust the position of the connector in the terminal according to the determined adjustment information in at least one of the following manners: adjusting an insulated transmission cable which is used for connecting the connector by a motor provided at at least one end of the guide rail; adjusting attractive force for attracting the connector by an electromagnetic attractive machine provided at at least one end of the guide rail; adjusting a gas force by an air pump disposed at at least one end of the guide rail; and adjusting hydraulic pressure by a hydraulic pump provided at at least one end of the guide rail.

Figure 6:
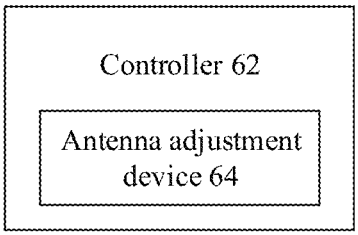
FIG. 6 is a structural block diagram of a controller according to an embodiment of the present disclosure.

FIG. 6 is a block diagram showing the structure of a controller according to an embodiment of the present disclosure. As shown in FIG. 6, the controller 62 includes an antenna adjustment device 64 as described above.

In an exemplary embodiment, a terminal is provided, including the controller as described above, a metal casing, a main-board, a connector for connecting the metal casing and the main-board and a device for adjusting a position of the connector for connecting the metal casing and the main-board, wherein the device adjusting a position of the connector for connecting the metal casing and the main-board includes at least one of a motor, an electromagnetic attractive machine, an air pump and a hydraulic pump.

It can be seen from the above device embodiments that a solution for dynamically changing the connection mode of the metal casing antenna trace and the main-board is proposed in the embodiments of the present disclosure. In the technical solution proposed by embodiments of the present disclosure, the whole antenna configuration can be changed indirectly. The terminal actively calculates the current conditions, the optimal antenna trace form (i.e., the antenna layout) is designed at any time, the liquid-state connection mode is controlled to form the current optimal antenna trace configuration, thereby achieving optimal antenna performance.

The following describes how to change the overall antenna configuration by using the connection methods in combination with the specific embodiments.

Figure 7:
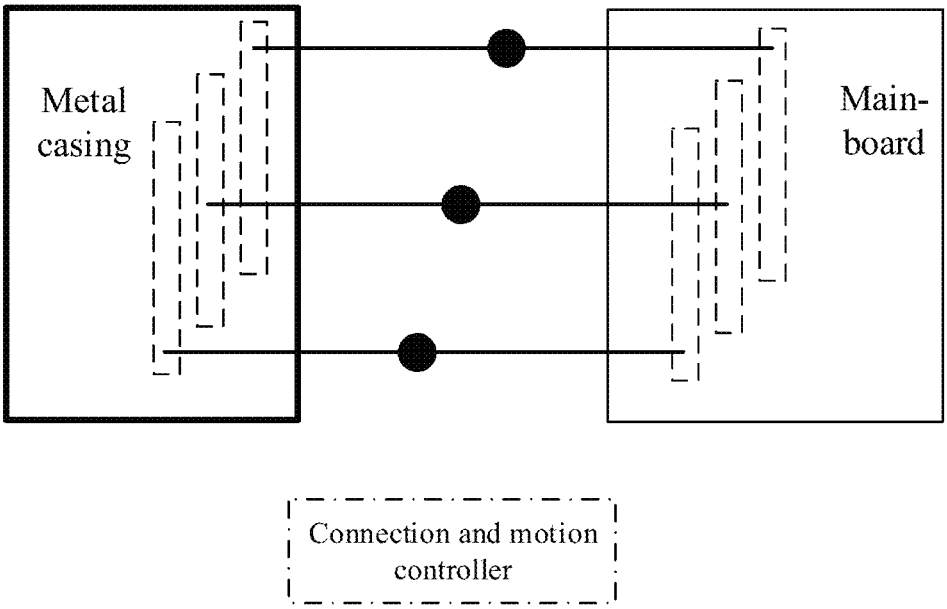
FIG. 7 is a hardware block diagram of a terminal according to an embodiment of the present disclosure.

Referring to FIG. 7, first, the black solid wire frame area is a metal casing, that is, an antenna wire that cannot be randomly designed.

Second, the black sphere is a connecting ball that connects the metal casing (i.e., the antenna) to the main-board circuit.

Third, the dotted rectangular grooves (in this figure, three rectangular grooves are shown, for example) are designed on the metal casing and the main-board, and the connecting ball (corresponding to the above-mentioned connector) can be moved in the grooves.

Finally, a connection and motion controller (corresponding to the controller 62 described above) is designed to control the movement of the three connecting balls.

The above three connecting balls have various positions (there are innumerable positions in theory), and a plurality of whole antenna configurations can be formed to satisfy the current scenario and obtain optimal antenna performance.

The connecting balls can be controlled in many ways. For example, the following schemes may be used to control the connecting balls.

Example 1

The currently used frequency band is determined. For example, if the currently used frequency band is the LTE frequency band of B3, it can be determined that the connecting balls should all move up in the antenna as shown in FIG. 7 so as to achieve optimal performance when the LTE frequency band of B3 is used. Then, the connection and motion controller is instructed to move the connecting balls to the top.

Example 2

The current usage situation such as the handheld mode of the user is determined. For example, if it is determined that the current handheld mode is a 2G call mode, it can be determined that the connecting balls should all move down in the antenna as shown in FIG. 7 so as to achieve optimal performance when the current handheld mode is the 2G call mode. Then, the connection and motion controller is instructed to move the connecting balls to the bottom.

Example 3

The current usage scenario (for example, the signal strength of a certain frequency band) is determined. For example, ifthe current GSM frequency band signal is weak, and is the current main use frequency band, it can be determined that the connecting balls should all be located in the middle in the antenna as shown in FIG. 7 so as to achieve optimal performance under the current GSM frequency band condition. Then, the connection and motion controller is instructed to move the connecting balls to be in the middle.

As shown above, there are many control modes for the three connecting balls, that is, there are multiple implementation manners for the "connection and motion controller" in the dotted line frame area in FIG. 7. Several implementations are described below as examples.

Implementation 1

Figure 8:
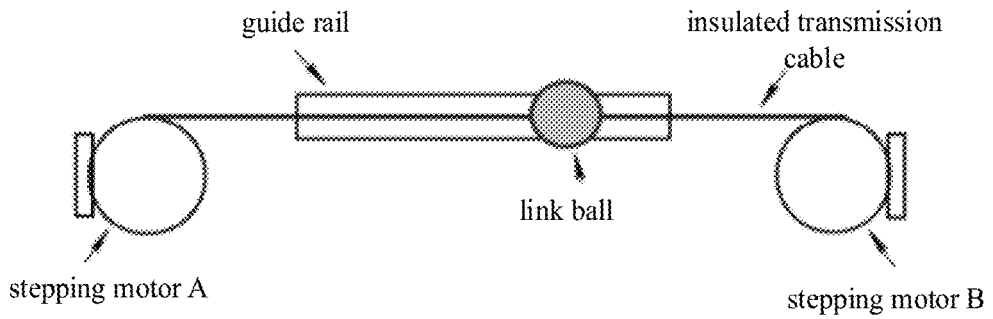
FIG. 8 is a schematic view showing that transmission is implemented by a mechanical stepping motor controlled by a connection and motion controller according to an embodiment of the present disclosure.

As shown in FIG. 8, the connection and motion controller controls mechanical stepping motors to implement transmission.

Two stepping motors are used to perform transmission to control the movement of the connecting ball (also called link ball), and the stepping motors are controlled according to the control manners as described.

The connecting ball is connected to the stepping motors by an insulated transmission cable.

The connecting ball can be moved within the guide rail according to the control manner to reach a predetermined position.

Implementation 2

Figure 9:
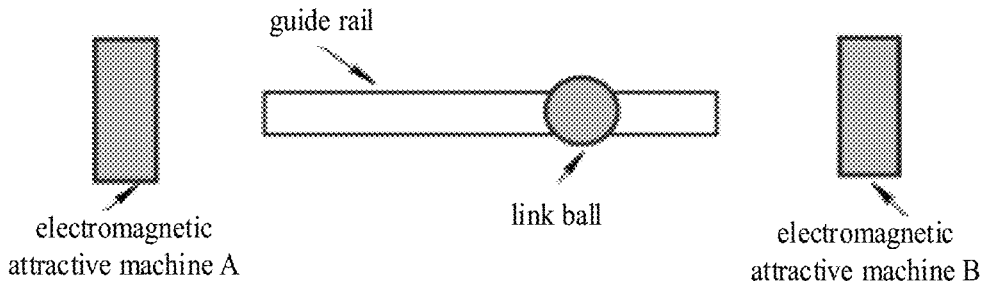
FIG. 9 is a schematic view showing that transmission is implemented by an electromagnetic attractive force controlled by a connection and motion controller according to an embodiment of the present disclosure.

As shown in FIG. 9, the connection and motion controller controls electromagnetic attractive machines to implement transmission.

Two electromagnetic attractive machines are used to control the movement of the connecting ball, and the electromagnetic attractive machines are controlled according to the control manners as described.

The connecting ball is subjected to an electromagnetic force to move.

The connecting ball can be moved within the guide rail according to the control method to reach a predetermined position.

Implementation 3

Figure 10:
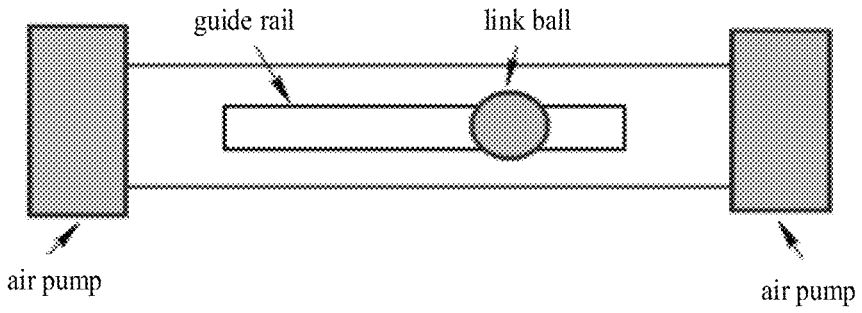
FIG. 10 is a schematic view showing that transmission is implemented by an air bump controlled by a connection and motion controller according to an embodiment of the present disclosure.

As shown in FIG. 10, the connection and motion controller controls air pumps to implement transmission.

The air pump devices are used to control the movement of the connecting ball, and the air pumps are controlled according to the above control manners.

The connecting ball is subjected to a gas force to move.

The connecting ball can be moved within the guide rail according to the control method to reach a predetermined position.

Implementation 4

Figure 11:
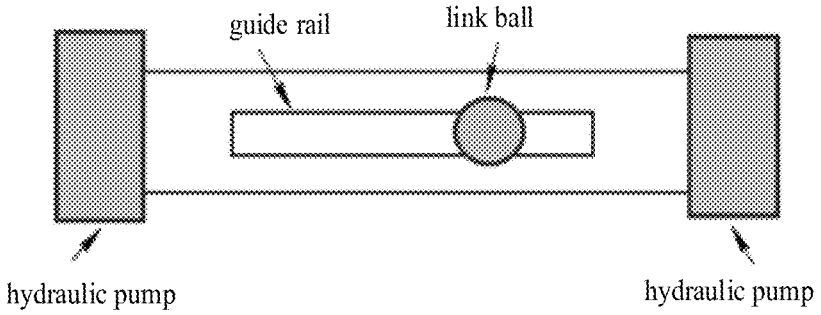
FIG. 11 is a schematic view showing that transmission is implemented by a hydraulic pump controlled by a connection and motion controller according to an embodiment of the present disclosure.

As shown in FIG. 11, the connection and motion controller controls hydraulic pumps to implement transmission.

The hydraulic pump devices are used to control the movement of the connecting ball, and the hydraulic pumps are controlled according to the above control manners.

The connecting ball is moved by the action of the liquid force.

The connecting ball can be moved within the guide rail according to the control method to reach a predetermined position.

Figure 12:
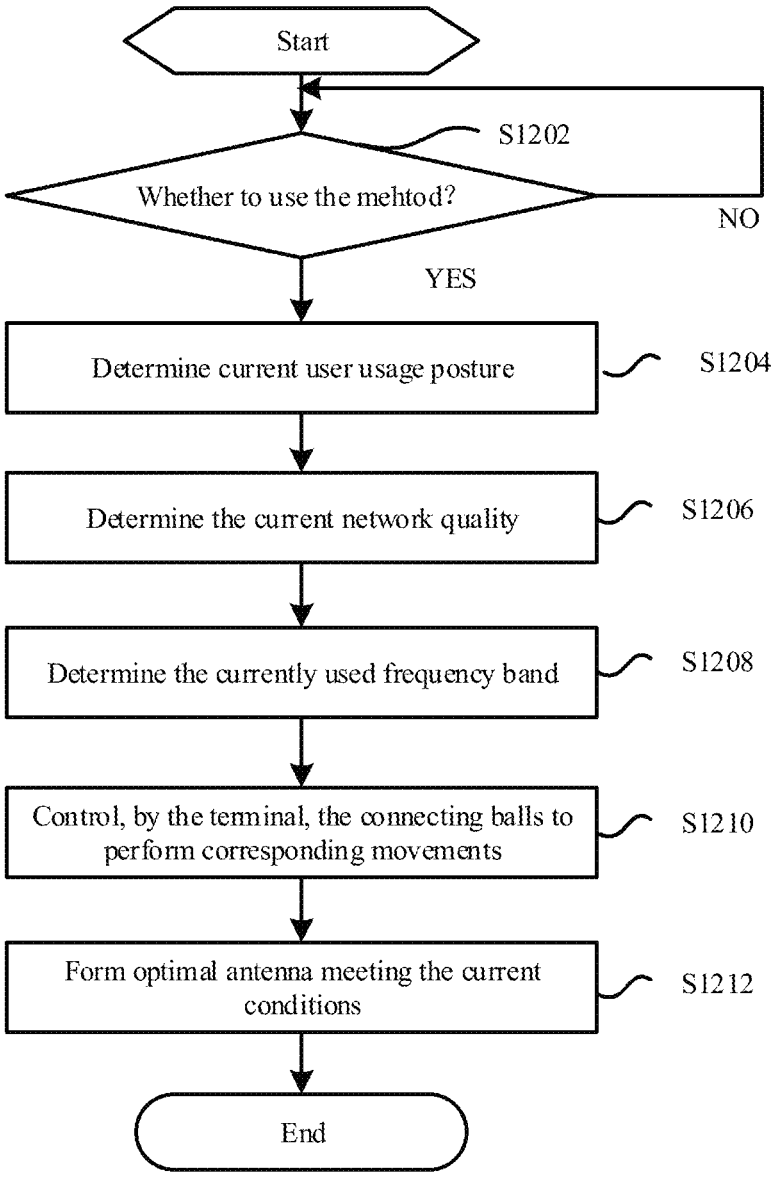
FIG. 12 is a flowchart of a method for adjusting an antenna in a terminal according to an embodiment of the present disclosure.

In an embodiment of the present disclosure, a method for adjusting an antenna in a terminal is further provided. As shown in FIG. 12, the method includes the following steps:

In step S1202, whether the method described in the embodiments of the present disclosure is activated is determined.

In step S1204, a current user usage posture is determined.

In step S1206, the current network quality is determined.

In step S1208, the currently used frequency band is determined.

In step S1210, the connection balls are controlled to move to form an antenna routing pattern corresponding to the current states.

In step S1212, an optimal antenna is obtained.

Finally, better antenna performance can be achieved by the method in the embodiment of the present disclosure.

It can be seen from the above embodiments that, in order to overcome the problems in the related arts, in the embodiment of the present disclosure, a scheme for dynamically changing the connection manner between the metal casing antenna trace and the main-board is proposed, which can indirectly change the overall antenna configuration. In this scheme, the terminal actively calculates the current conditions, designs the optimal antenna routing form every moment, controls the liquid-state connection mode, and forms the current optimal antenna routing pattern to achieve optimal antenna performance.

It should be noted that each of the foregoing modules may be implemented by software or hardware. For the latter, implementations may be but not limited to: the foregoing modules are all located in the same processor; or, the foregoing modules are located in different processors in any combination.

An embodiment of the present disclosure also provides a storage medium.

Optionally, in the embodiment, the storage medium may be configured to store program codes for executing the steps in the foregoing method embodiments.

Optionally, in the embodiment, the foregoing storage medium may include, but is not limited to, a USB flash drive, a Read-Only Memory (ROM), and a Random Access Memory (RAM), a hard disk, a magnetic disk, or an optical disk, or other media that can store program codes.

Optionally, in this embodiment, the processor performs the steps in the foregoing method embodiments according to the stored program codes in the storage medium.

The specific implementations in the embodiment may refer to the examples described in the foregoing embodiments and the exemplary embodiments, and details are not described herein again.

It will be apparent to those skilled in the art that the various modules or steps of the present disclosure described above can be implemented by general-purpose computing devices, which can be centralized on a single computing device or distributed across a network composed of multiple computing devices. Alternatively, the modules or steps may be implemented by program codes executable by the computing devices such that they may be stored in a storage device to be executed by the computing devices. In some cases, the shown or described steps may be performed in an order different from that described herein. Or, the modules or steps shown or described are fabricated separately into individual integrated circuit modules, or a plurality of modules or steps are fabricated as a single integrated circuit module. Thus, the present disclosure is not limited to any specific combination of hardware and software.

The above description only shows exemplary embodiments of the present disclosure, and the exemplary embodiments are not intended to limit the present disclosure. Various modifications and changes can be made to the present disclosure. Any modifications, equivalent substitutions, improvements and so on made within the spirit and scope of the present disclosure are intended to be included within the scope of the present disclosure.

INDUSTRIAL APPLICABILITY

As described above, an antenna adjustment method, an adjustment device, a controller, and a terminal provided by the embodiments of the present disclosure have the following beneficial effects. The antenna of the terminal is adjusted according to the actual environments of the terminal (for example, the system and/or frequency band actually used by the terminal, the signal quality of the actually used network band, and the area where the terminal is actually covered), thereby ensuring the performance of the antenna and the communication quality, improving the user experience, and effectively solving the technical problem in related art that when the environments in which the terminal is located are changed, because the terminal multi-band antenna is difficult to implement and/or the terminal supports a small number of system frequency bands, the terminal antenna performance is deteriorated, thereby causing the communication quality to become poor and affecting user experiences.

What is claimed is:

1. An antenna adjustment method, comprising:

determining adjustment information for adjusting an antenna formed by a metal casing of a terminal; and adjusting the antenna according to the determined adjustment information, wherein adjusting the antenna according to the determined adjustment information comprises: adjusting a position of a connection point of the metal casing of the terminal and a main-board of the terminal according to the determined adjustment information;

wherein adjusting a position of a connection point of the metal casing of the terminal and a main-board of the terminal according to the determined adjustment information, comprises:

adjusting a position of a connector in the terminal according to the determined adjustment information, wherein the connector is located in a space of a guide rail formed by at least one groove on the metal casing and at least one groove on the main-board, the at least one groove on the metal casing correspond to the at least one groove on the main-board in a one-to-one manner, and the connector is disposed to connect the metal casing and the main-board.

2. The method according to claim 1, wherein adjusting the position of the connector in the terminal according to the determined adjustment information comprises at least one of:

adjusting an insulated transmission cable which is used for connecting the connector by a motor provided at at least one end of the guide rail;

adjusting attractive force for attracting the connector by an electromagnetic attractive machine provided at at least one end of the guide rail;

adjusting a gas force by an air pump disposed at at least one end of the guide rail; and adjusting hydraulic pressure by a hydraulic pump provided at at least one end of the guide rail.

3. A terminal, comprising:

a processor;

a metal casing; a main-board;

a connector for connecting the metal casing and the main-board; and a device for adjusting a position of the connector for connecting the metal casing and the main-board, wherein the device for adjusting a position of the connector for connecting the metal casing and the main-board comprises at least one of a motor, an electromagnetic attractive machine, an air pump and a hydraulic pump;

wherein the processor is configured to:

determine adjustment information for adjusting an antenna formed by the metal casing of the terminal; and adjust the antenna according to the determined adjustment information, wherein the processor is configured to adjust a position of a connection point of the metal casing of the terminal and the main-board of the terminal according to the determined adjustment information;

wherein the processor is configured to:

adjust a position of the connector in the terminal according to the determined adjustment information, wherein the connector is located in a space of a guide rail formed by at least one groove on the metal casing and at least one groove on the main-board, the at least one groove on the metal casing correspond to the at least one groove on the main-board in a one-to-one manner, and the connector is disposed to connect the metal casing and the main-board.

4. The terminal according to claim 3, wherein the processor is configured to:

adjust an insulated transmission cable which is used for connecting the connector by the motor provided at at least one end of the guide rail;

adjust attractive force for attracting the connector by the electromagnetic attractive machine provided at at least one end of the guide rail;

adjust a gas force by the air pump disposed at at least one end of the guide rail; and adjust hydraulic pressure by the hydraulic pump provided at at least one end of the guide rail.

5. A computer readable storage medium having stored therein instructions that, when executed by a processor of a terminal, causes the terminal to perform an antenna adjustment method, comprising:

determining adjustment information for adjusting an antenna in a metal casing of a terminal; and adjusting the antenna according to the determined adjustment information, wherein adjusting the antenna according to the determined adjustment information, comprises:

adjusting a position of a connection point of the metal casing of the terminal and a main-board of the terminal according to the determined adjustment information:

wherein adjusting a position of a connection point of the metal casing of the terminal and a main-board of the terminal according to the determined adjustment information, comprises:

adjusting a position of a connector in the terminal according to the determined adjustment information, wherein the connector is located in a space of a guide rail formed by at least one groove on the metal casing and at least one groove on the main-board, the at least one groove on the metal casing correspond to the at least one groove on the main-board in a one-to-one manner, and the connector is disposed to connect the metal casing and the main-board.

6. The computer readable storage medium according to claim 5, wherein adjusting the position of the connector in the terminal according to the determined adjustment information comprises at least one of:

adjusting an insulated transmission cable which is used for connecting the connector by a motor provided at at least one end of the guide rail;

adjusting attractive force for attracting the connector by an electromagnetic attractive machine provided at at least one end of the guide rail;

adjusting a gas force by an air pump disposed at at least one end of the guide rail; and adjusting hydraulic pressure by a hydraulic pump provided at at least one end of the guide rail.

* * * * *